US009643224B2

(12) United States Patent
Breuer et al.

(10) Patent No.: US 9,643,224 B2
(45) Date of Patent: May 9, 2017

(54) DEVICE AND METHOD FOR COOLING ROLLED STOCK

(71) Applicant: SMS SIEMAG AG, Düsseldorf (DE)

(72) Inventors: Michael Breuer, Hilchenbach (DE); Andreas Gramer, Solingen (DE); Johannes Alken, Siegen (DE); Dietrich Mathweis, Düsseldorf (DE); Heiko Zetzsche, Hilchenbach (DE)

(73) Assignee: SMS GROUP GMBH, Düsseldorf (DE)

( * ) Notice: Subject to any disclaimer, the term of this patent is extended or adjusted under 35 U.S.C. 154(b) by 41 days.

(21) Appl. No.: 14/653,960

(22) PCT Filed: Nov. 26, 2013

(86) PCT No.: PCT/EP2013/074751

§ 371 (c)(1),
(2) Date: Jun. 19, 2015

(87) PCT Pub. No.: WO2014/095268

PCT Pub. Date: Jun. 26, 2014

(65) Prior Publication Data

US 2015/0314349 A1 Nov. 5, 2015

(30) Foreign Application Priority Data

Dec. 19, 2012 (DE) ..... 10 2012 223 848

(51) Int. Cl.
*B21B 37/74* (2006.01)
*B21B 45/02* (2006.01)

(52) U.S. Cl.
CPC ..... *B21B 45/0218* (2013.01); *B21B 45/0206* (2013.01); *B21B 45/0209* (2013.01);
(Continued)

(58) Field of Classification Search
CPC . B21B 37/74; B21B 45/0203; B21B 45/0209; B21B 45/0215; B21B 45/0218;
(Continued)

(56) References Cited

U.S. PATENT DOCUMENTS 2,211,981 A * 8/1940 McBain ..... B21B 39/16 72/201
3,041,686 A * 7/1962 Hazelett ..... B21B 45/0203 164/443
(Continued)

FOREIGN PATENT DOCUMENTS

DE 1917621 A1 * 10/1969 ..... B21B 45/0233
DE 2844434 A1 4/1980
(Continued)

OTHER PUBLICATIONS

Australian Examination Report, Date of issue: Apr. 1, 2016.

*Primary Examiner* — Edward Tolan
(74) *Attorney, Agent, or Firm* — Lucas & Mercanti, LLP; Klaus P. Stoffel

(57) ABSTRACT

A device for cooling rolled stock, preferably for cooling during cold rolling, including a nozzle for applying a cooling medium to the rolled stock, wherein a cooling chamber that is in fluid communication with the nozzle and extends substantially parallel to the strip running plane is provided for applying the cooling medium to the rolled stock.

21 Claims, 14 Drawing Sheets

(52) U.S. Cl.
CPC ..... *B21B 45/0233* (2013.01); *B21B 37/74* (2013.01); *B21B 45/0281* (2013.01); *B21B 2261/20* (2013.01)

(58) Field of Classification Search
CPC ..... B21B 2045/0221; B21B 45/0224; B21B 45/0233; B21B 45/0293
See application file for complete search history.

(56) References Cited

U.S. PATENT DOCUMENTS 3,892,391 A * 7/1975 Okuno ..... B21B 45/004 266/132
4,619,126 A * 10/1986 Kolecki ..... B21B 9/00 72/201
5,329,779 A * 7/1994 Lozano ..... B21B 45/0224 62/374
8,511,126 B2 8/2013 Mathweis et al.
2009/0108508 A1* 4/2009 Ueoka ..... B21B 45/0218 266/44
2010/0013242 A1 1/2010 Schwarz et al.
2012/0104666 A1* 5/2012 Kobayashi ..... B21B 45/0218 266/44
2012/0318478 A1* 12/2012 Weinzierl ..... B21B 37/76 165/104.11

FOREIGN PATENT DOCUMENTS

DE 3431125 A1 3/1986
DE 19718530 A1 11/1998
DE 102007055475 A1 1/2009
DE 102009007863 A1 8/2010
EP 1527829 A1 5/2005
JP S5886904 A 5/1983
JP S591641 A 1/1984
JP S63101017 A 5/1988
JP S63101017 A 5/1998
SU 774653 A1 10/1980
WO 9315854 A1 * 8/1993 ..... B21B 45/02

* cited by examiner

DEVICE AND METHOD FOR COOLING ROLLED STOCK

The present application is a 371 of International application PCT/EP2013/074751, filed Nov. 26, 2013, which claims priority of DE 10 2012 223 848.4, filed Dec 19, 2012, the priority of these applications is hereby claimed and these applications are incorporated herein by reference.

BACKGROUND OF THE INVENTION

The present invention pertains to a device for cooling rolled stock, preferably in a rolling train.

PRIOR ART

Devices and methods for cooling rolled stock in a rolling train are well known. During the production of strip and sheet in rolling trains, the control and management of the metal temperature is of the greatest importance for various reasons. In the process of the hot-rolling of steel strip or of heavy plate, the microstructure of the rolled stock can be converted, after the final rolling, into a wide variety of different states by careful temperature control; such states can comprise ferritic, pearlitic, bainitic, or martensitic components. This temperature control is implemented by cooling devices downstream from the finishing trains, of which there are various known configurations.

Cooling sections for influencing the rolled stock in similar ways are also known for other materials such as aluminum, copper and copper alloys, magnesium, titanium, nickel, and other metals.

In cold-rolling trains for steel or other metals, the rolled stock heats up as a result of the rolling energy introduced into it as it is being formed. Here, too, certain damaging temperature ranges for the rolled stock must be avoided. In the case of steel, for example, this is the temperature range of blue brittleness. Coarse grains, furthermore, tend to form in certain materials at elevated temperatures. Cooling devices are thus also used in cold-rolling mills for strip.

When a rolling oil is used such as kerosene, which tends to self-ignite and which can ignite very quickly, the temperature of the rolled stock must again be controlled to prevent such ignition.

In this connection, spray cooling systems, for example, are known, which apply a coolant onto the strip by means of nozzles. A cooling device of this type is known from EP 1 527 829 A1, for example, which introduces the coolant onto the rolled stock through nozzles.

In addition, JP S63-101017 discloses a cooling device for cooling hot strips. Here, cooling water under high pressure is sprayed directly on the strips. In this spray cooling, to prevent the water sprayed on the strip from splashing in the surrounding area unhindered, and to selectively remove the sprayed water, the cooling device on the one hand includes plates to carry away the water arranged parallel to the strip and on the other hand drainage rollers arranged underneath the strips. The plates to carry away the water present an uncontrolled flow away, i.e., drainage, of the cooling water in an area under the cooling device. The dripping coolant heads to a lower drainage roller, which collects coolant that adheres to the bottom of the strip. Through an upper drainage roller, the coolant on the upperhalf of the strip is skimmed and is directed to an upper plate for carrying away the water.

Laminar cooling systems are also known, which conduct a jet onto the rolled stock at almost no pressure. According to DE 197 18 530 A1, furthermore, a cooling device operating by concurrent flow especially for hot wide strip is known, in which the intensity of the cooling is controlled by the coordination of independently adjustable parameters (cooling time, volume flow rate, pressure, etc.). To avoid unstable film evaporation, a safety interval from the boiling point of the coolant is maintained.

Also known are intensive cooling systems, Mulpic systems, intermediate stand cooling units, laminar cooling sections for hot strip production, as well as spray cooling systems. These systems are often encapsulated so that the drainage of the coolant can be controlled.

The disadvantage of the previously known solutions is that the coolant is conducted in the form of a jet onto the sheet or strip or other rolled medium and strikes that material with a certain kinetic energy. At the point of impact of the jet on the rolled stock, a large amount of heat transfer occurs. The jet, however, breaks down completely, and the kinetic energy of the jet is lost. From what is left of the jet, a chaotic off-flow of coolant forms, which has a significantly weaker cooling effect on the strip.

The jet of coolant breaks down in an uncontrolled manner and is distributed in various directions. In the case of rolled stock which is traveling slowly, the coolant drains off in the direction of the jet. In the case of a fast-traveling strip, however, the coolant is carried along with the strip. The presence of coolant outside the cooling device, however, is usually undesirable, because a strip coated with coolant can slip from the deflecting rolls, can contaminate the rolling hall itself, can contaminate the strip, can be the source of various emissions such as odors and aerosols, can interfere with measuring instruments, and can have a disadvantageous effect on the effort to achieve the tribologically correct conditions for the rolled stock in the roll gap.

The known cooling devices are thus sealed off by contact with rolls and seals or the like to avoid the entrainment of coolant into other areas of the plant, as disclosed in DE 28 44 434 A1, for example.

SUMMARY OF THE INVENTION

Against the background of the prior art described above, the goal of the present invention is to provide a device for cooling rolled stock which comprises a more uniform heat transfer and reduces the contamination of the surroundings.

Thus the device for cooling rolled stock, preferably for cooling during cold rolling, comprises a nozzle for applying a coolant to the rolled stock. According to the invention, a cooling chamber for applying the coolant to the rolled stock is provided, this chamber being in fluid communication with the nozzle and extending parallel to the strip passline, the device comprising an adjusting device for reversing of flow direction of the coolant in the cooling chamber by moving an outer shroud of the device, the sheath is movable from the first position to a second position, so that based on a setting of the sheath, two feed lines and two chain lines are connected so that the flow direction is changeable.

Because the cooling chamber is configured to extend along the rolled stock, i.e., along the strip passline, for application of the coolant to the rolled stock, the coolant is guided in a defined manner. If the cooling chamber is configured appropriately, it is also possible to prolong considerably the time during which the coolant can act on the rolled stock; this action is geometrically defined, furthermore, and can be executed in controlled fashion.

Uncontrolled runoff of the coolant from the rolled stock is also suppressed, so that an undesirable intrusion of coolant into other areas of the plant can be reduced.

In contrast to spray cooling systems, it is also possible significantly to increase the surface onto which the coolant acts, because the cooling channel makes it possible to supply coolant to a geometrically defined area.

The backspray which occurs when the coolant strikes the rolled stock is also avoided in the manner according to the invention. Because of the effective guidance of the coolant along the rolled stock, furthermore, the pressure level of the coolant can also be reduced, as a result of which energy savings can be achieved, because the coolant does not have to be put under such high pressure.

The cooling chamber is preferably positioned between the rolled stock and a chamber roof. In this way, direct contact between the cooling fluid and the rolled stock is achieved, and variations in the distance between the chamber roof and the rolled stock can be easily compensated by the adjusting the volume flow rate.

The nozzle is preferably configured in such a way that the coolant can be directed into the cooling chamber as an essentially uniform flow. As a result of the formation of the uniform flow, a uniform heat transfer distribution can be achieved.

A slit nozzle can be considered an especially suitable form of nozzle, which comprises a gap of constant size across the width of the cooling chamber.

The transition from the nozzle to the cooling chamber is preferably provided with a separation edge, which, for example, can be realized in the form of a height offset between the nozzle gap and the cooling chamber roof. This prevents the supplied fluid flow from adhering to the cooling chamber roof upon emergence from the nozzle gap or from preferentially following the roof instead of leaving the nozzle gap in the desired direction toward the surface of the strip and thus filling the cooling chamber.

The cooling chamber is preferably configured in such a way that the coolant can flow through the cooling chamber as an essentially uniform flow. It is especially advantageous here for the cross section of the cooling chamber to be essentially constant in the strip travel direction. Thus, as a result of the uniform flow in the cooling chamber, uniform cooling over the entire contact surface can be achieved. Such uniform cooling would no longer be present if vortices were to form.

In another preferred elaboration, the cooling chamber extends in the direction opposite to the strip travel direction, so that the coolant is conducted in the direction opposite to that in which the strip travels. It is especially preferred in this connection for the nozzle to be situated behind the cooling chamber, i.e., downstream from it with respect to the strip travel direction. As a result of this countercurrent cooling, especially effective use of the coolant is achieved. In particular, the coolant is used first at the coldest area of the rolled stock and then flows to the hotter areas of the rolled stock, as a result of which optimal heat transfer occurs in all areas.

The cooling chamber can comprise at least one cooling chamber roof extending parallel to the rolled stock and preferably at least one side wall perpendicular to the rolled stock and extending in the strip travel direction to form a lateral boundary of the cooling chamber. Thus the cooling chamber can be easily constructed.

In another preferred elaboration of the cooling device, a flow brake in the form of, for example, a sealing strip can be installed a certain distance away from the outlet end, where the flow leaves the cooling chamber, or a similar measure for constricting the cooling chamber can be provided to prevent the fluid from freely leaving the cooling chamber.

To adapt the cooling chamber to different strip widths of the rolled stock to be cooled, the device in a preferred form has at least one adjustable side wall, which is positioned at a defined distance from the strip width of the rolling stock to be cooled. As a result, the flow in the cooling chamber is guided with optimal fashion, and the formation of vortices is prevented.

So that the coolant can be removed from the rolled stock, the cooling chamber can be followed in the flow direction by a drainage chamber for removing the coolant from the rolled stock. It is especially preferred in this connection for the drainage chamber to be larger than the cooling chamber, so that the flow velocity of the coolant is slower in the drainage chamber than in the cooling chamber.

In a preferred elaboration, the supply of coolant to the nozzle can be automatically controlled, preferably by means of a controllable pump unit, and the supply of coolant is determined as a function of various parameters of the rolled stock, preferably as a function of the temperature of the rolled stock, the material of the rolled stock, and/or the residual fluid on the rolled stock after passage through the device.

So that the rolled stock can be threaded in, the cooling chamber can be swung away from the plane of the rolled stock.

To protect other plant components from contamination, at least one removal device, i.e., a device for removing excess coolant from the rolled stock, can be provided outside the cooling chamber, preferably in the form of an air-blast device, a spray device, a suction device, a transverse air-blast device, and/or a blower.

Preferred exemplary embodiment and aspects of the present invention are explained in greater detail in the following description of the figures:

BRIEF DESCRIPTION OF THE DRAWING

FIG. 13 shows a schematic diagram of how the cooling device can be opened so that the strip can be threaded in;

DETAILED DESCRIPTION OF THE INVENTION

In the following, preferred exemplary embodiments are described on the basis of the figures. Elements which are the same or similar or which function in the same or a similar way are designated by the same reference numbers, and in some cases the description of these elements is not repeated to avoid redundancies in the description.

Figure 1:
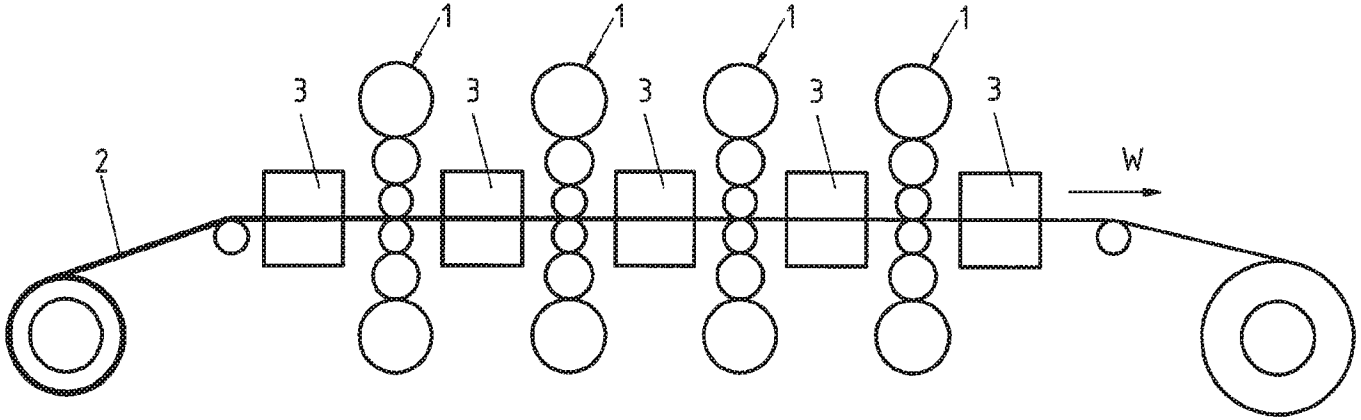
FIG. 1 shows a schematic diagram of a rolling train with rolling stands and devices for cooling.

FIG. 1 shows a schematic diagram of a rolling train with several rolling stands 1, by means of which the rolled stock 2 is rolled thinner. Schematically illustrated cooling devices 3 for cooling the rolled stock 2 are located in front of the first stand, behind the last stand, and between the stands.

Figure 2:
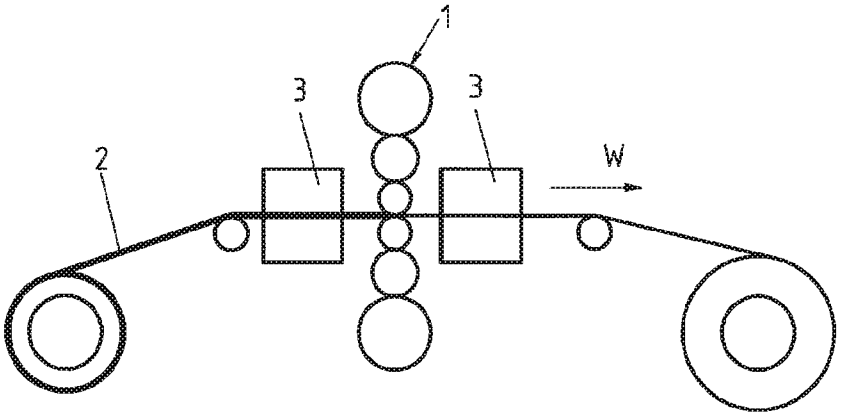
FIG. 2 shows a schematic diagram of a reversing stand with a device for cooling.

FIG. 2 shows another rolling train, in this case with a reversing stand 1, also shown schematically, in front of and behind which are cooling devices 3 for cooling the rolled stock 2.

It is immediately clear from FIGS. 1 and 2 that the cooling device 3 can be arranged at any desired point, i.e., in front of the rolling stand 1 in question, between rolling stands, or behind the rolling stand in question. There is therefore a corresponding freedom with respect to the arrangement of the cooling devices 3, which can be placed wherever they best serve the purpose of the specific rolling process in question.

Figure 3:
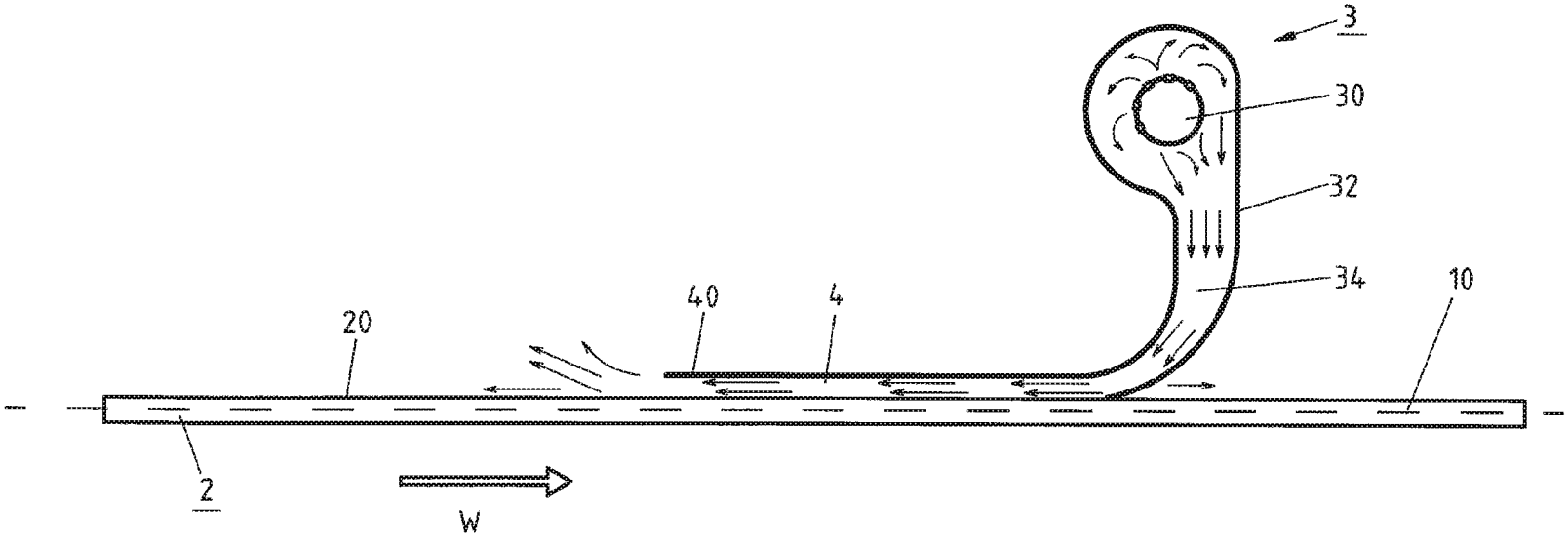
FIG. 3 shows a device for cooling rolled stock with a cooling chamber.

FIG. 3 shows a schematic diagram of a cooling device 3, which is supplied with coolant through a feed line 30. The feed line 30 is provided with a diffusor, so that the coolant 34 can be introduced uniformly into a nozzle 32, which surrounds the diffusor.

In the case of the schematically illustrated nozzle 32, because of the geometry of the nozzle 32, in particular because of an appropriate constriction, the coolant 34 is formed into a uniform, accelerated flow, in which form it then leaves the nozzle 32.

Following the nozzle 32 is a cooling chamber 4, which extends essentially parallel to the plane 10 defined by the rolled stock 2, also called the strip passline, the chamber being configured to apply the coolant 34 to the rolled stock 2. After the rolled stock 2 has been threaded into it, the cooling chamber 4 thus extends also essentially parallel to the rolled stock 2. In the cooling chamber 4, the coolant 34 flows out of the nozzle 32 and comes in contact with the rolled stock 2. Thus there is a transfer of heat from the rolled stock 2 to the coolant 34, at least in the area of the cooling chamber 4. As will be described further below on the basis of FIG. 5, the rolled stock 2 is cooled very effectively as a result of the long and defined contact time of the coolant 34 with the rolled stock 2—especially as compared to the effectiveness of simply spraying the rolled stock 2.

The cooling chamber 4 consists essentially of a chamber roof 40, which preferably follows immediately after the nozzle 32. The chamber roof 40 is arranged opposite the top surface 20 of the rolled stock 2, so that the coolant 34 flowing through the nozzle 32 is conducted from the nozzle 32 into the cooling chamber 4, in which the coolant 34 then flows along the rolled stock 2 in a manner essentially free of vortices.

The thick arrow indicates the strip travel direction W of the rolled stock 2. It can be seen immediately that the cooling chamber 4, starting from the nozzle 32, is oriented in the direction opposite to the strip travel direction. In other words, the nozzle 32 is arranged downstream, with respect to the strip travel direction W, from the cooling chamber 4.

The cross section of the cooling chamber 4 is essentially constant in the strip travel direction, so that the flow velocity of the coolant 34 in the cooling chamber 4 is essentially constant, and simultaneously an essentially vortex-free flow can also be formed. As a result, the coolant 34 comes in contact with the rolled stock 2 in the area of the cooling chamber 4 in such a way that an efficient and uniform flow without vortices is present here.

At the end of the cooling chamber 4, the coolant 34 emerges as a diffuse flow and can be collected in the usual way.

Figure 4:
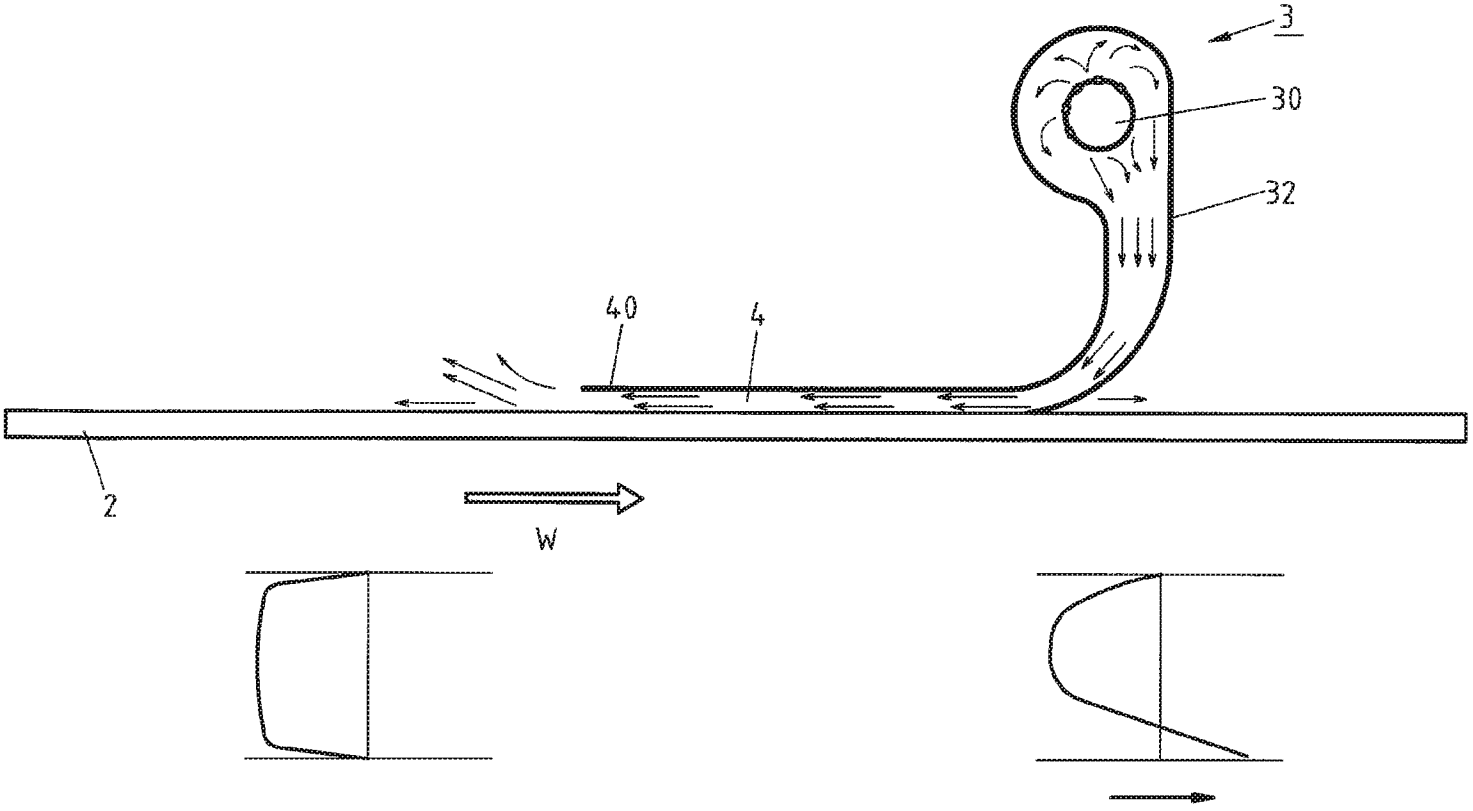
FIG. 4 shows the device for cooling according to FIG. 3 with a detailed illustration of the flow relationships.

FIG. 4 shows the structure of the cooling device 3 schematically illustrated in FIG. 3 once again in detail, especially with respect to the flow relationships. The strip travel direction W of the rolled stock 2 is again indicated by the thick arrow.

The velocity distribution of the flow within the cooling chamber 4 is shown schematically. The diagram at the bottom left shows the largely symmetric velocity profile of the flow without a moving strip, i.e., at zero strip velocity. With a moving strip or a non-zero strip velocity, an asymmetric velocity profile is obtained, as shown in the diagram at the bottom right. As a result of the movement of the strip, the relative velocity between the flow and the surface of the strip is increased, which amplifies the cooling effect, that is, the transfer of heat from the surface of the strip to the coolant.

The nozzle 32 is configured in such a way that a uniform flow velocity across the entire cooling chamber 4 is obtained.

Figure 5:
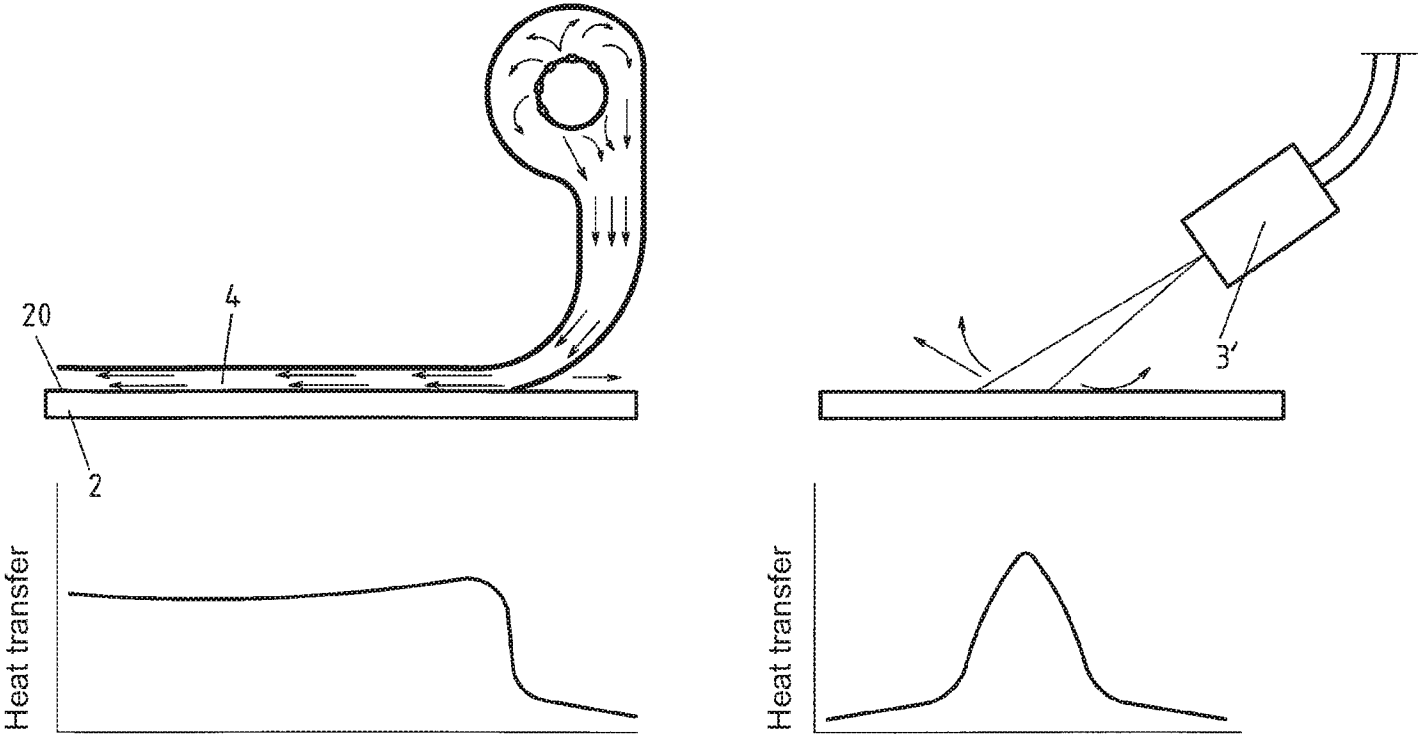
FIG. 5 shows a comparison between the heat transfer in a device for cooling rolled stock as proposed above and that of a conventional spray cooling system.

FIG. 5 shows a comparison between the cooling device 3 as shown in FIGS. 2 and 3 and a conventional spray device 3'. In the cooling device 3 according to FIGS. 2 and 3, an essentially uniform flow is formed, which is conducted through the cooling chamber 4. It is thus possible to achieve the heat transfer shown schematically under this device in the area of the cooling chamber 4. Thus a constant heat transfer is obtained on the surface 20 of the rolled stock 2, as can be seen from the schematic diagram underneath.

In contrast, the spray device 3', as indicated by the arrows, results in a large amount of swirling and a considerable amount of coolant backspray. The resulting cooling action is thus evident only at individual points, as can be seen from the schematic diagram.

Figure 6:
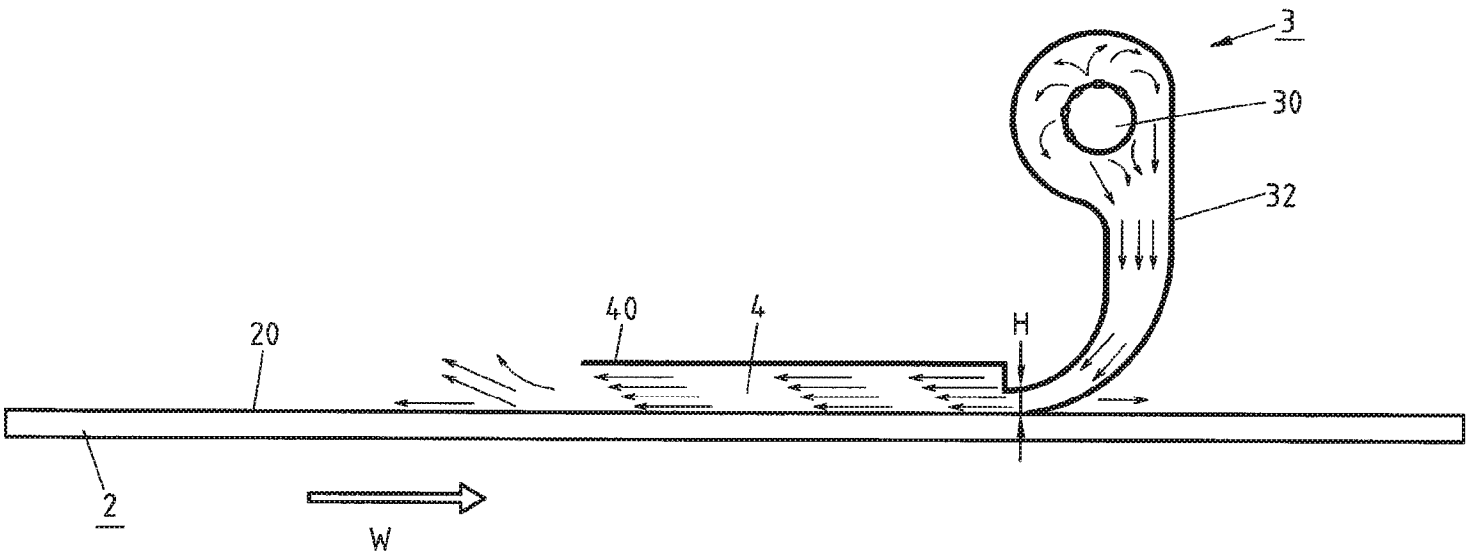
FIG. 6 shows a schematic diagram of an especially advantageous embodiment of the transition between nozzle and cooling chamber.

FIG. 6 shows a schematic diagram of a preferred form of the cooling device 3, in which, at the transition from the nozzle 32 to the cooling chamber 4, a separation edge can be seen. This has the job of preventing the fluid flow from adhering to the roof of the cooling chamber and thus of conducting the flow to the surface of the strip and filling the cooling chamber more effectively. The separation edge in this example has been realized by an offset between the height of the nozzle gap and the roof of the chamber, so that the distance between the chamber roof and the strip surface is greater than the height H of the nozzle gap above the strip surface.

Figure 7:
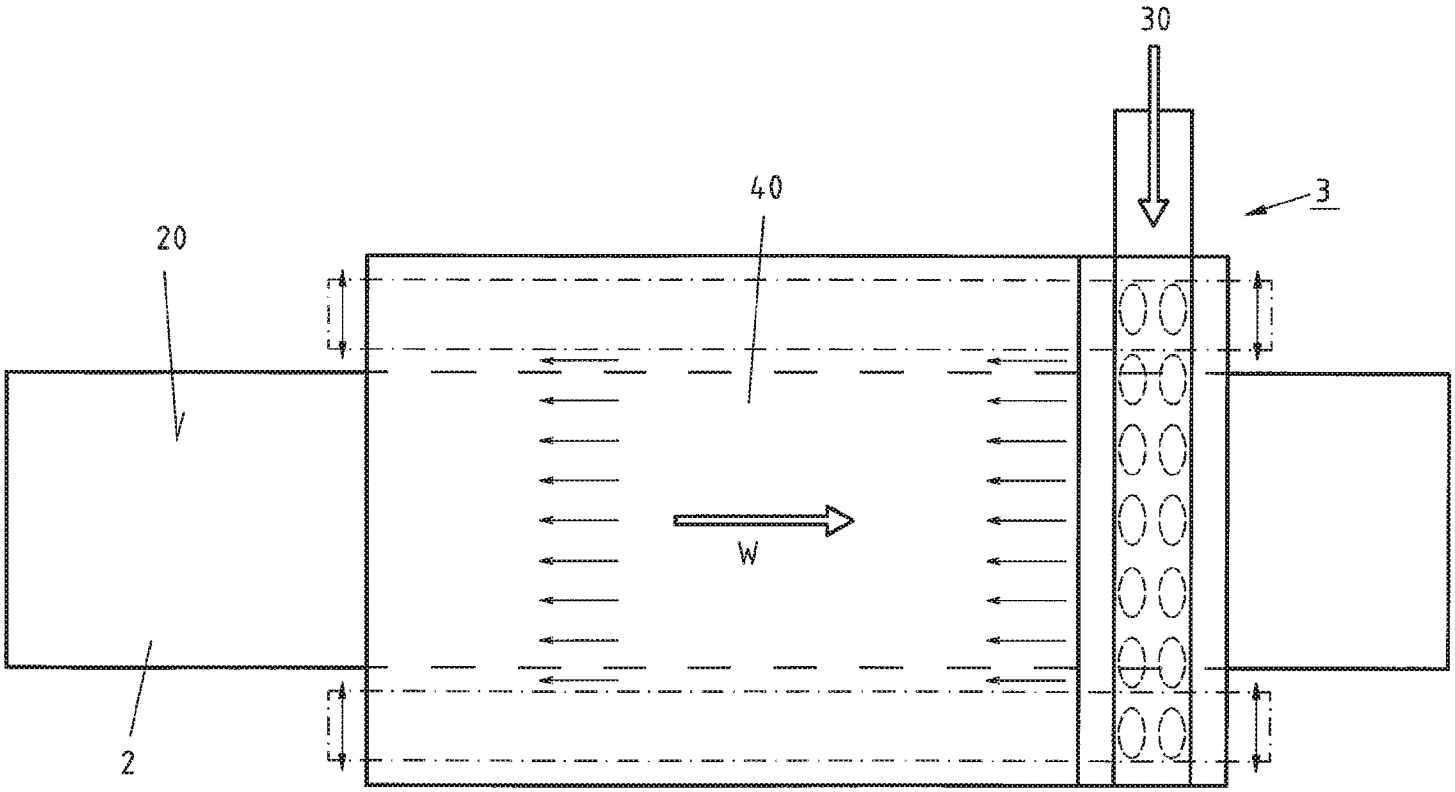
FIG. 7 shows a schematic diagram of a preferred embodiment of the strip cooling system with adjustable side walls for adapting the chamber to the width of the strip.

FIG. 7 shows another preferred embodiment of the cooing device, in which the width of the cooling chamber 4 is adapted to the width of the strip material currently being processed. In the example shown, this is accomplished by shifting the two side walls of the cooling chamber 4, which are essentially parallel to the strip width. The side walls in FIG. 7 are shown in dash-dot line; they can be shifted in the direction of the double arrows. Adjusting the width of the channel ensures optimal guidance of the flow along the rolled stock and suppresses the formation of vortices. The distance between the edge of the strip and the side wall of the cooling chamber is in the range of 2-100 mm, and preferably in the range of 10-50 mm, wherein the channel width may be less than 10% greater than the strip width of the rolled stock.

Figure 8:
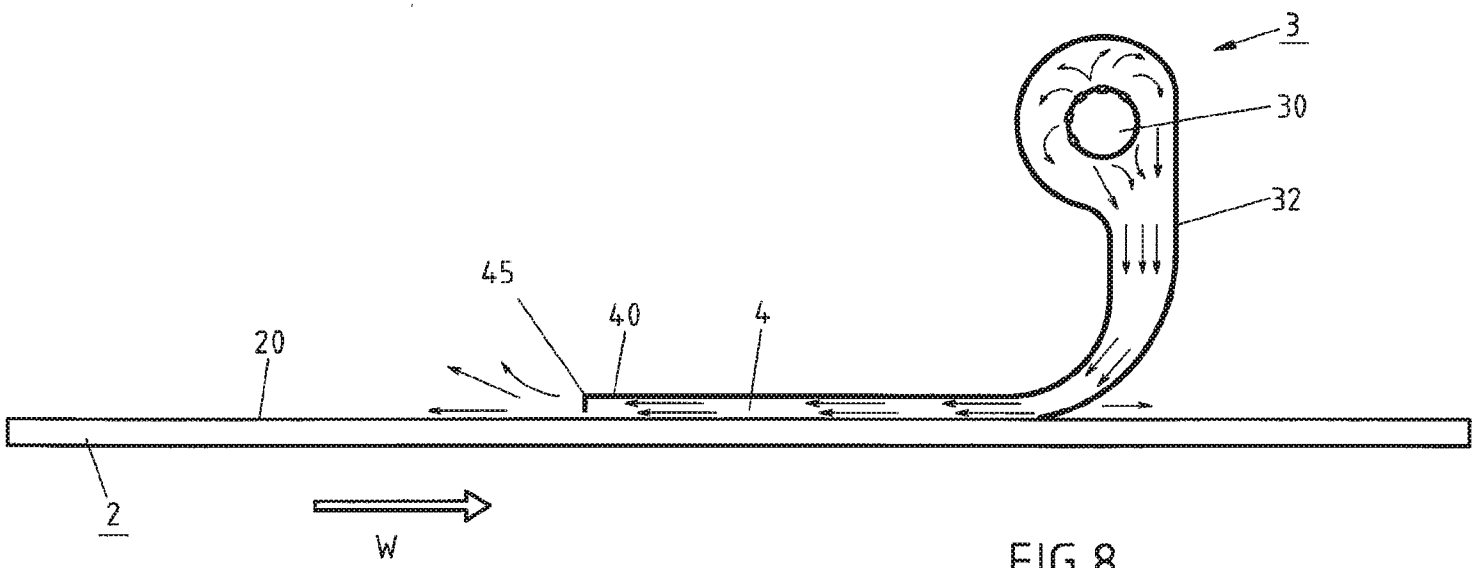
FIG. 8 shows a schematic diagram of a preferred embodiment of the strip cooling system with a flow brake at the outlet where the flow leaves the cooling chamber.

FIG. 8 shows another preferred embodiment of the cooling device, in which a flow brake in the form of, for example, a sealing strip a certain distance away from the strip surface or in the form of a similar cooling chamber constriction prevents the free outflow of the coolant from the cooling chamber.

Figure 9:
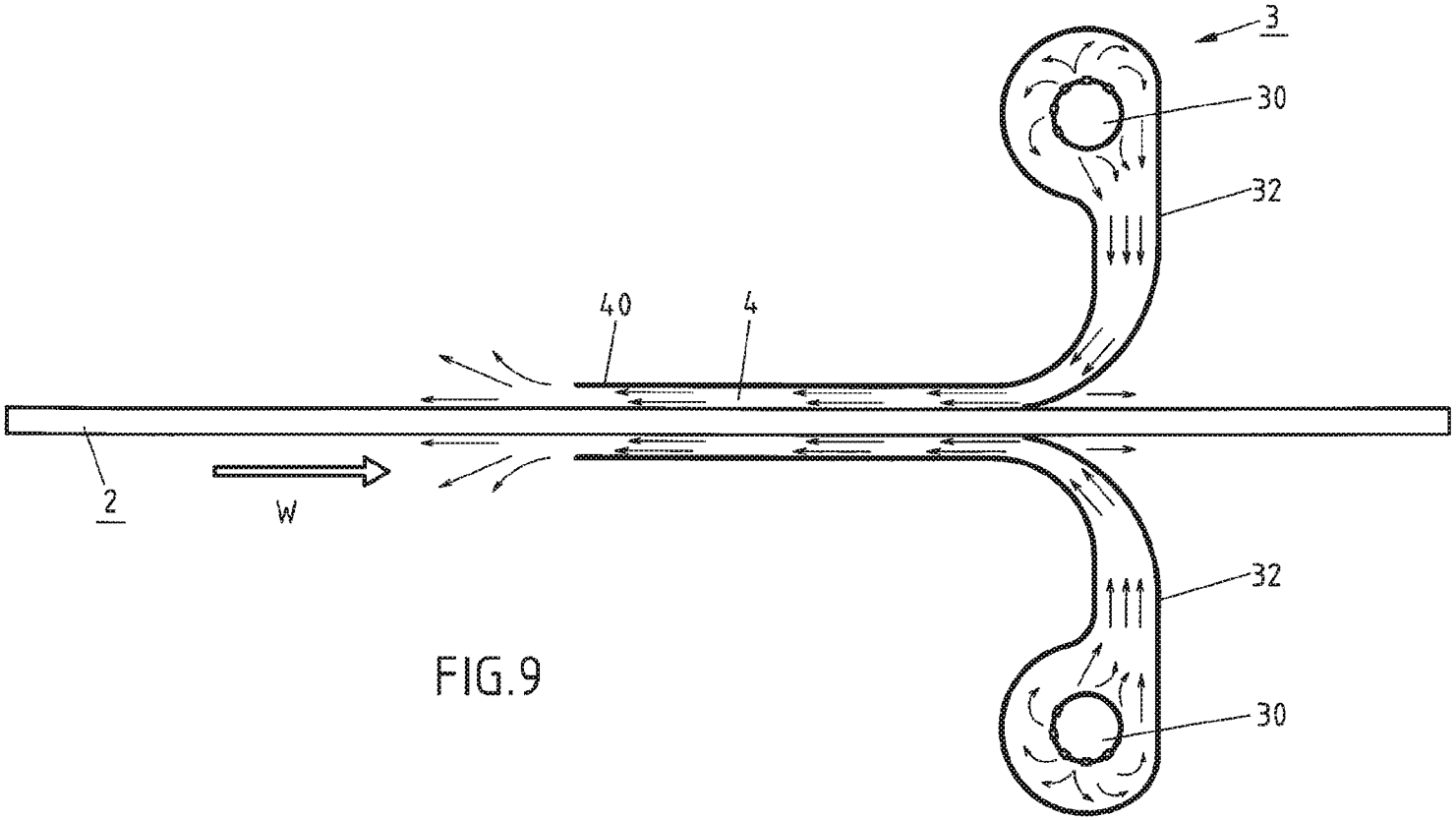
FIG. 9 shows a schematic diagram of another exemplary embodiment of a device for cooling rolled stock.

FIG. 9 shows another embodiment of a cooling device 3, wherein a cooling device 3 of the type already shown by way of example in FIGS. 2 and 3 is now arranged on both sides of the rolled stock 2. Thus the top surface and also the bottom surface of the rolled stock 2 can now be cooled.

Figure 10:
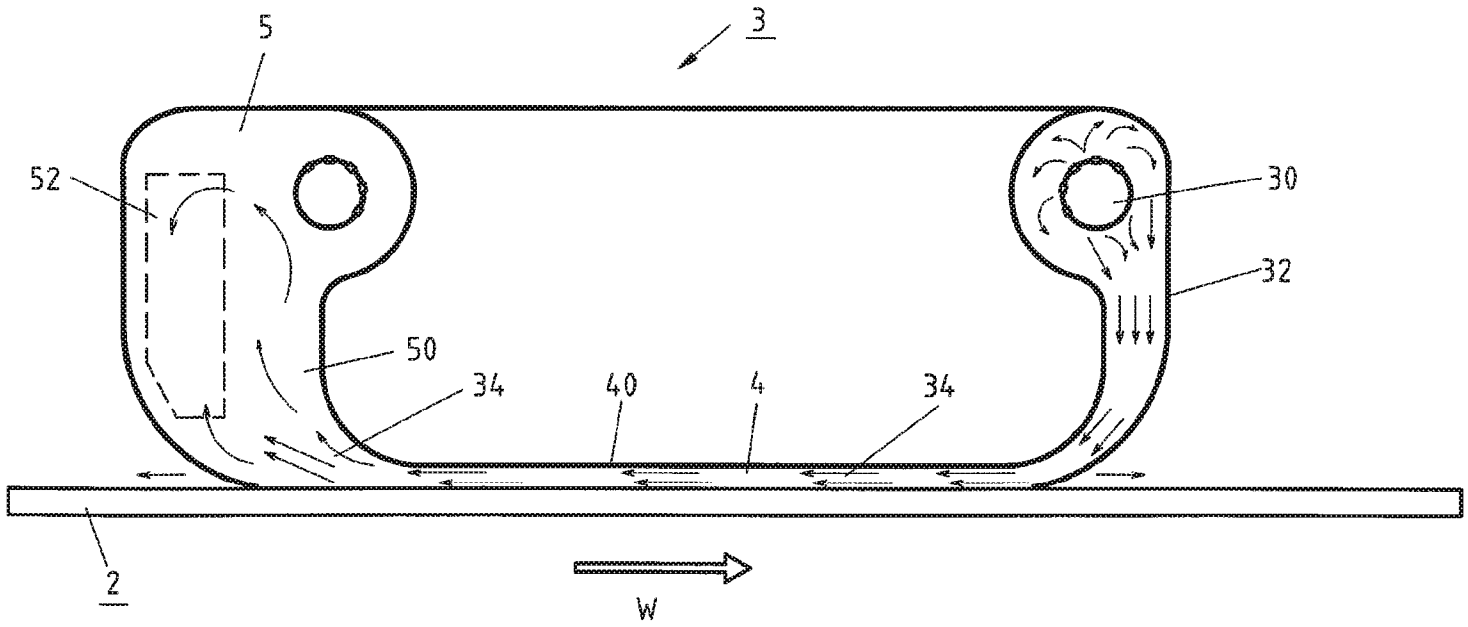
FIG. 10 shows a device for cooling rolled stock together with a drainage chamber.

FIG. 10 shows another embodiment of a cooling device 3, wherein again the arrangement of nozzle 32 and cooling chamber 4 already familiar from the preceding exemplary embodiments is provided. Following the cooling chamber in the flow direction is now a drainage chamber 5, which is configured to collect the coolant 34 flowing through the cooling chamber 4 and to carry it away.

The drainage chamber 5 is configured so that it is connected to the chamber roof 40 of the cooling chamber 4 and provides a collecting volume 50, in the side of which a drain opening 52, shown schematically, is arranged. The coolant 34 flows into the drain opening 52 and cannot contaminate the surroundings or the rolled stock 2. It is also easy in this way to recirculate the coolant 34, because, after it has been sent through the feed line 30 and the nozzle 32 and brought into contact with the rolled stock 2, it can then be removed from the rolled stock 2 via the drainage chamber 5.

Figure 11:
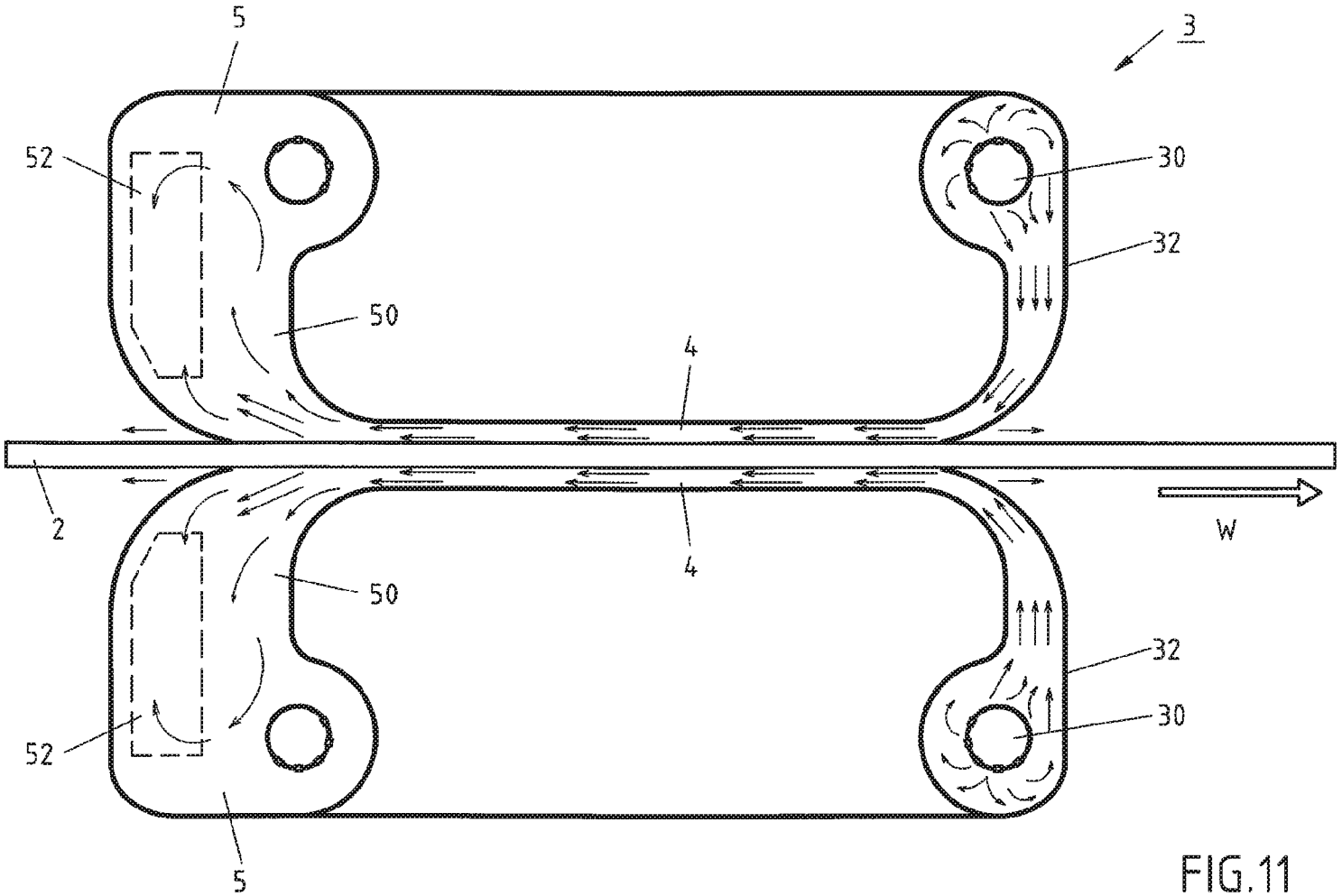
FIG. 11 shows a device for cooling rolled stock with a drainage chamber on both sides of the strip.

FIG. 11 shows a corresponding configuration, in which again a corresponding device with drainage device is shown on both the top and the bottom sides of the rolled stock 2.

Figure 12A:
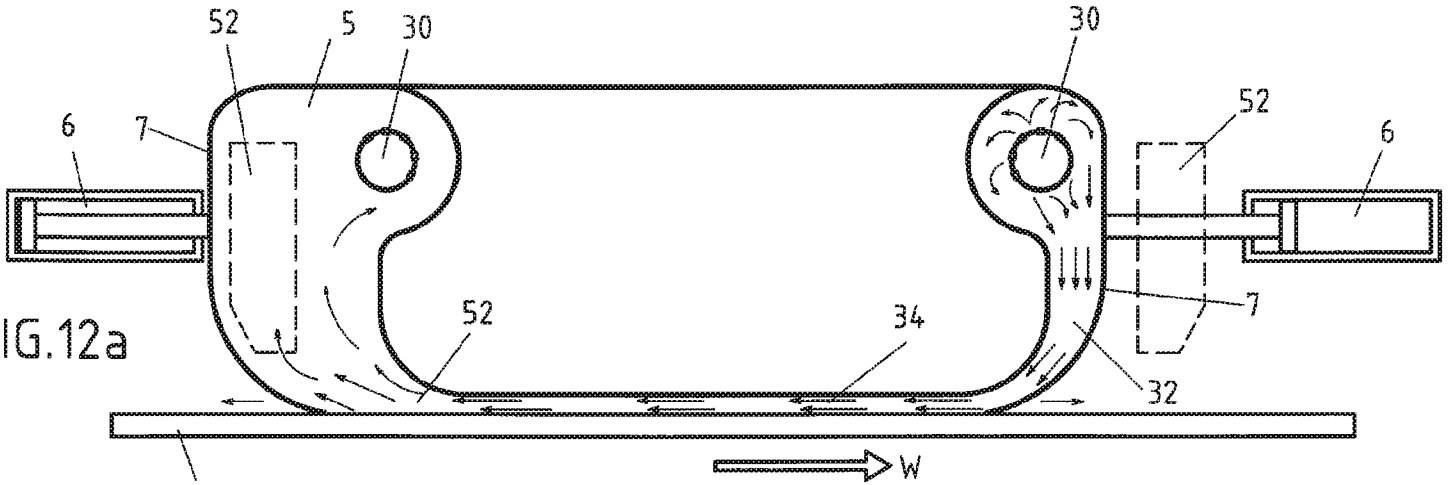
FIGS. 12*a* and 12*b* show diagrams of a device for cooling a strip with a drainage chamber, which can be adjusted as a function of the strip travel direction.
Figure 12B:
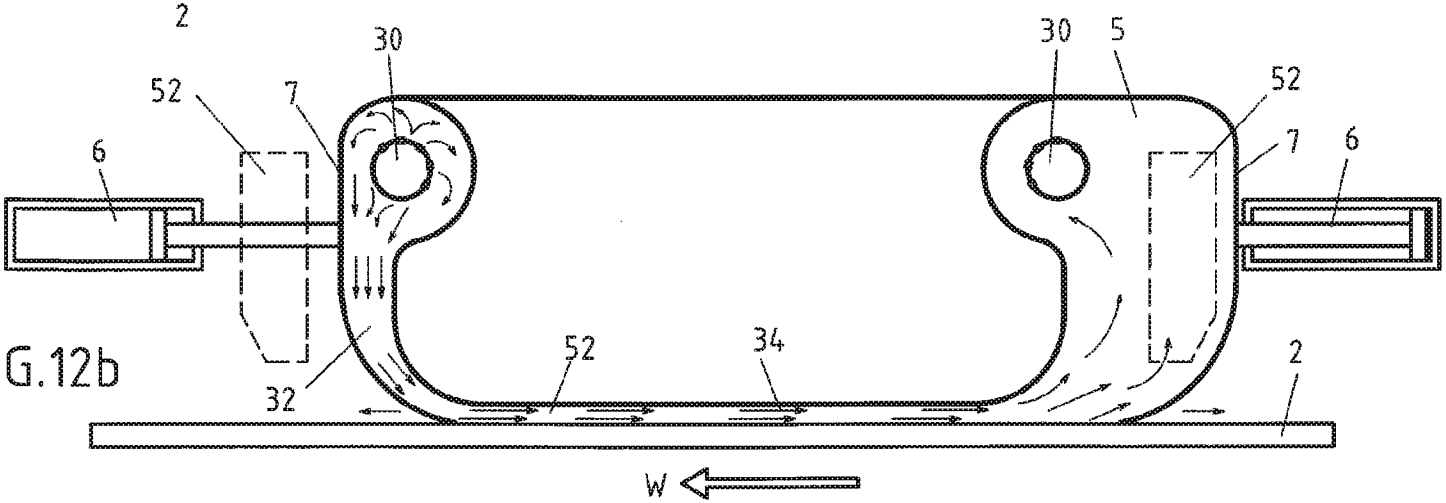

In FIG. 12, another device for cooling rolled stock 2 is provided, wherein again the device for cooling is provided with the nozzle 32, the cooling chamber 4, and the drainage chamber 5. By means of adjusting cylinders 6, the outer shroud 7 of the device can be manipulated in such a way that the flow direction of the coolant 34 can be changed. This is important when the direction in which the strip is traveling is reversed, as in the case of a reversing stand, for example.

For this purpose, the outer shroud 7 is pushed from the first position, shown at the top at 12*a*, into a second position, shown at the bottom at 12*b*. Thus two feed lines 30 and two drains 52 are provided, which are connected to each other as necessary, depending on the position of the outer shroud 7, to achieve the desired flow of the coolant 34.

Figure 13:
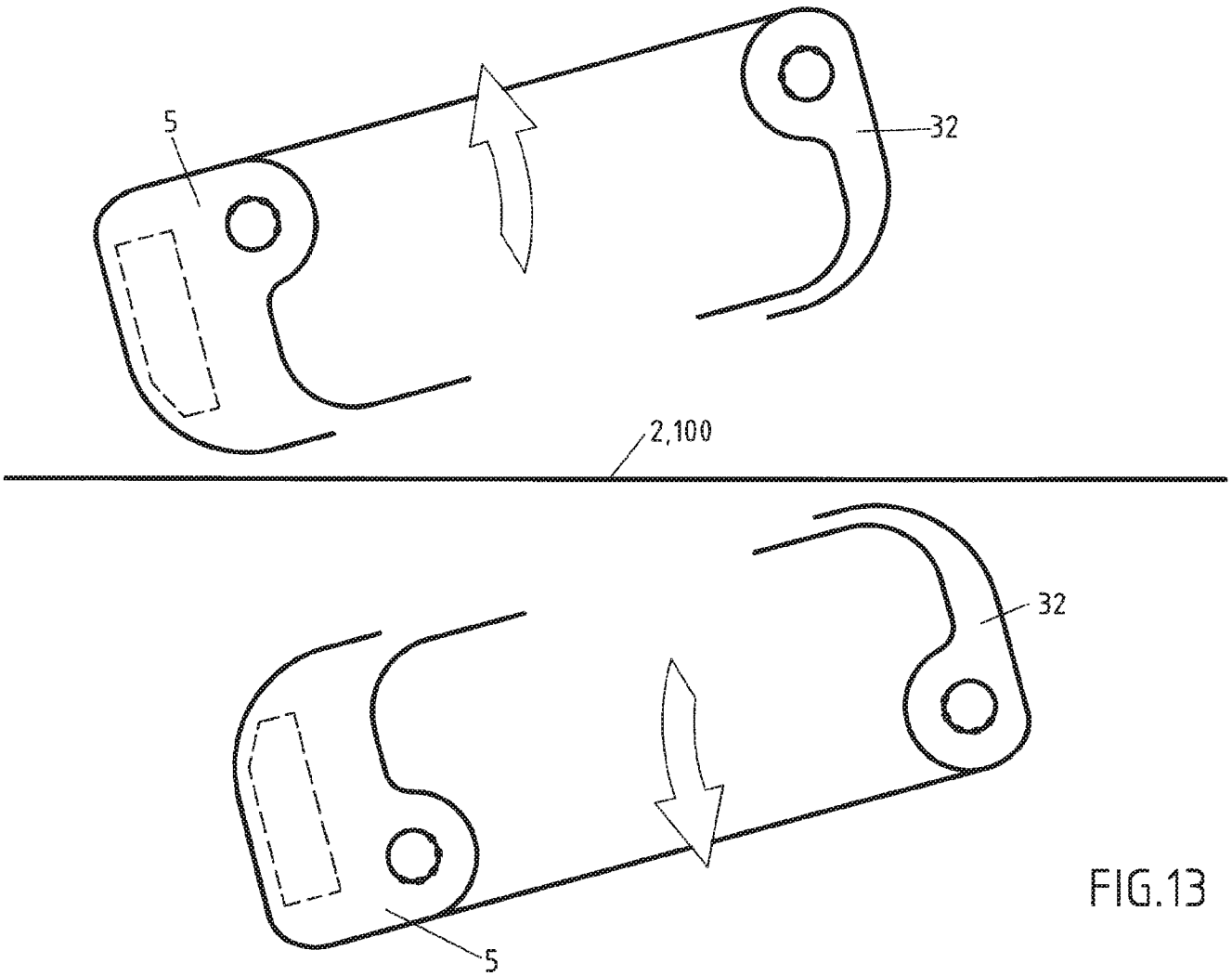

FIG. 13 shows in general how the entire device can be swung away from the top and from the bottom of the rolled stock 2, i.e., from the passline 100, so that the stock can be threaded in more easily or so that maintenance work can be carried out more conveniently.

Figure 14:
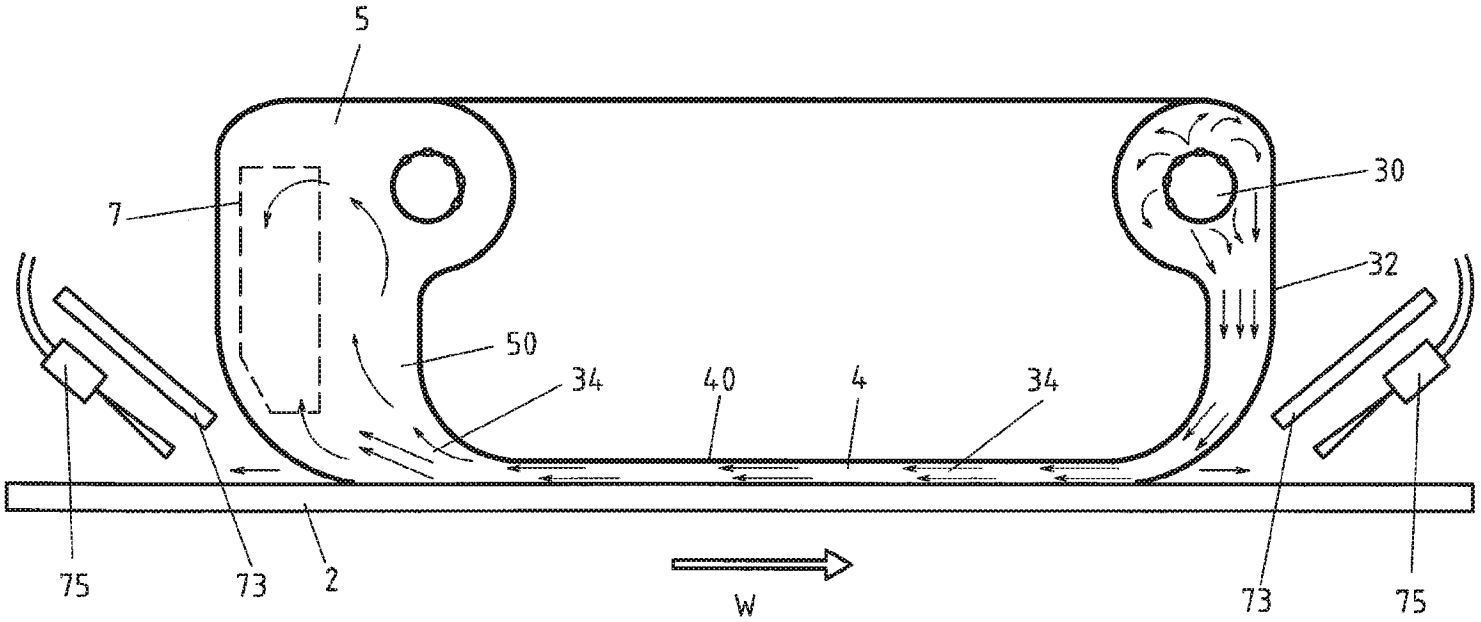
FIG. 14 shows another device for cooling rolled stock with removal devices on both sides serving a barrier function and with a deflector plate.

FIG. 14 corresponds in principle to the exemplary embodiment shown in FIGS. 7 and 8. Upstream and downstream, in the strip travel direction W, from the cooling chamber, there is in each case an air-blast device, also called a removal device, as indicated schematically in the form of the blast nozzles 75. Upstream and downstream, in the strip travel direction W, from the cooling chamber 4 with nozzle 32 and drain chamber 5, there is in each case a removal device with barrier function and deflector plate 73, also shown schematically. The removal device protects adjacent systems from contamination. The blasts or backsprays discharged by the removal device, furthermore, can also provide a barrier function, and the off-flow of the escaping fluid can be optimized by the deflector plates. The blasts or backsprays keep the coolant 34 in the cooling chamber 4 or drive escaping coolant 34 back into the cooling chamber 4. The deflector plate collects escaping coolant and conducts it effectively away.

In this way, other areas of the plant can be protected from contamination with coolant 34.

Figure 15:
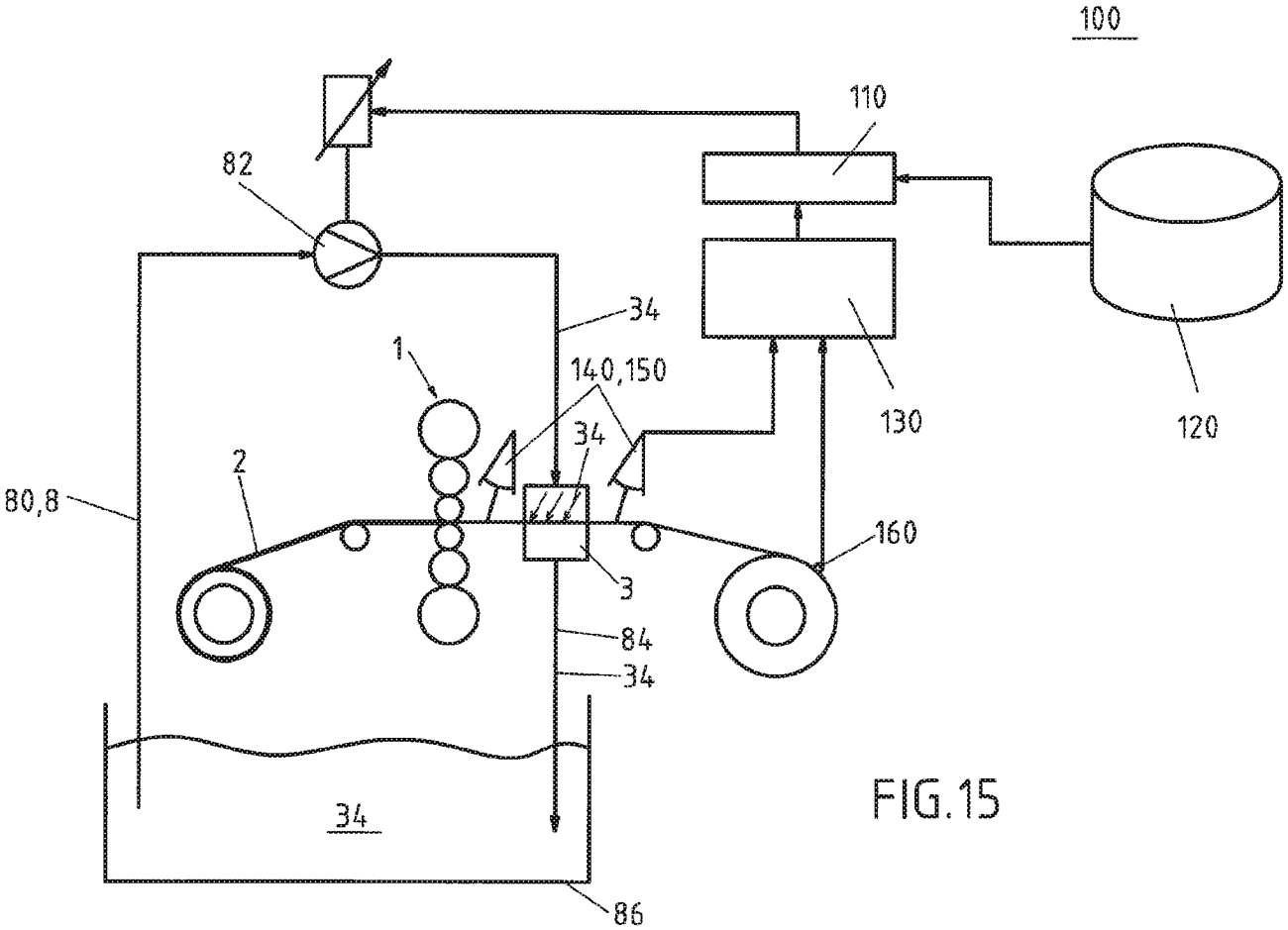
FIG. 15 shows a schematic diagram of a control unit together with the device for cooling rolled stock.

FIG. 15 shows a schematic diagram of the automatic control mechanism for the present device for cooling rolled stock. In particular, the rolled stock 2 is guided through a rolling stand 1 and then treated with coolant 34 in a cooling device 3. The device for cooling the rolled stock 2 is supplied with the coolant by a pump circuit 8. The pump circuit 8 comprises a suction line 80, an automatically controlled pump 82, a coolant drain line 84, and a collecting tank/reservoir 86.

The coolant is thus pumped from the collecting tank/reservoir 86 through the suction line 80 by means of the automatically controlled pump 82 into the device 3 for cooling rolled stock 2. There the coolant 34 is brought into contact with the rolled stock 2. Then the coolant is collected again by way of the drainage chamber 5 shown in the preceding figures and sent back to the reservoir/collecting tank 86 via the drain line 84.

The automatically controlled pump 82 is actuated by an automatic control unit 100. The control unit 100 comprises a controller 110, which takes over the actual job of automatically adjusting the controllable pump 82 by adjusting its output, for example. The controller 110 is supplied with parameters 120, which comprise, for example, a characteristic curve of the controllable pump 82 or other parameters relating to the geometric configuration of the cooling chamber 4, to the different materials of the rolled stock 2, to different pass sequences, to different velocities of the rolled stock 2, etc.

The various parameters of the rolling process measured by sensors are evaluated by an evaluation unit 130, on the basis of which the controller 110 is actuated.

In the evaluation unit 130, sensors 140, 150, for example, which are configured as residual fluid or temperature sensors, participate in the evaluation of the actual state of the rolled stock 2. In addition, residual fluid sensors 140 can be used to monitor the correct functioning of the device for cooling rolled stock, so that residual fluid is not transported onward on the rolled stock 2 or is transported onward only within narrowly set limits. The temperature sensors can be used to adjust the cooling power of the device for cooling in such a way that the desired microstructure is obtained.

A speed sensor 160 is also provided, which determines the speed at which the rolled stock 2 is coiled.

The various parameters are evaluated in the evaluation unit 130 to obtain a uniform control command, which is then transmitted to the controller 110.

Insofar as applicable, all of the individual features presented in the individual exemplary embodiments can be combined with each other and/or exchanged for each other without leaving the scope of the invention.

LIST OF REFERENCE SYMBOLS

1 rolled stock
10 strip passline
100 control unit
110 controller
120 parameter
130 evaluation unit
140 temperature sensor
150 residual fluid sensor
160 speed sensor
2 rolled stock
20 surface of the rolled stock
3 cooling device
3' nozzle
30 feed line (with diffusor)
32 nozzle
34 coolant
4 cooling chamber
40 cooling chamber roof
45 flow brake
5 drainage chamber
50 volume of the drainage chamber
52 drain opening
6 adjusting cylinder
7 outer shroud
73 deflector plate
75 blast nozzles
8 fluid circuit
80 suction line
82 automatically controlled pump
84 coolant drain line
86 reservoir
W strip travel direction

The invention claimed is:

1. A device for cooling flat rolled stock, comprising:

an outer shroud arranged at only one surface of the flat rolled stock;

a nozzle for applying a coolant to the rolled stock;

a cooling chamber in fluid communication with the nozzle and extending essentially parallel to a strip passline for applying the coolant to only the one surface of the rolled stock; and an adjusting device for moving the outer shroud substantially parallel to the strip passline and the one surface to reverse a flow direction of the coolant in the cooling chamber, wherein the outer shroud is shiftable from a first position to a second position so that, depending on the position of the outer shroud, two feed lines and two drains are respectively connectable to each other so that the flow direction of the coolant is changed.

2. The device according to claim 1, wherein the cooling chamber is positioned between the rolled stock and a chamber roof.

3. The device according to claim 1, wherein the nozzle is configured so that the coolant is conducted as an essentially uniform flow into the cooling chamber.

4. The device according to claim 1, wherein the cooling chamber is configured so that the coolant flows through the cooling chamber as an essentially uniform flow.

5. The device according to claim 1, wherein the cooling chamber has a cross section that is essentially constant in a strip travel direction.

6. The device according to claim 1, wherein the cooling chamber extends in a direction opposite to a strip travel direction so that the coolant is guided in the direction opposite to the strip travel direction.

7. The device according to claim 6, wherein the nozzle is situated downstream, with respect to the strip travel direction, from the cooling chamber.

8. The device according to claim 1, wherein the nozzle is a slit nozzle.

9. The device according to claim 1, wherein the cooling chamber comprises at least one cooling chamber roof extending parallel to the rolled stock and at least one side wall perpendicular to the rolled stock and extending in the strip travel direction to form a lateral boundary of the cooling chamber.

10. The device according to claim 1, wherein a transition from the nozzle to the cooling chamber comprises a separation edge for the flow of the coolant into the cooling chamber.

11. The device according to claim 1, wherein the cooling chamber has side walls at a distance to the strip width between 2 mm and 100 mm, but never more than 10% relative to the strip width.

12. The device according to claim 11, wherein the distance is between 10 mm and 50 mm.

13. The device according to claim 1, wherein an outlet side of the flow from the cooling chamber comprises a flow brake.

14. The device according to claim 1, further comprising a drainage chamber following the cooling chamber for removing the coolant from the rolled stock.

15. The device according to claim 14, wherein the drainage chamber is larger than the cooling chamber to reduce flow velocity of the coolant in the drainage chamber in comparison to flow velocity in the cooling chamber.

16. The device according to claim 1, wherein a feed of coolant to the nozzle is automatically controllable by a controllable pump unit, and the feed of the coolant is determined as a function of various parameters of the rolled stock.

17. The device according to claim 16, wherein the parameters of the rolled stock include at least one of the group consisting of: temperature of the rolled stock, material of the rolled stock, and residual fluid on the rolled stock after rolled stock passed through the device.

18. The device according to claim 1, wherein at least the cooling chamber is movable away from a plane of the rolled stock to facilitate threading-in of the rolled stock.

19. The device according to claim 1, further comprising at least one device provided outside the cooling chamber for removing excess coolant from the rolled stock.

20. The device according to claim 19, wherein the at least one device for removing excess coolant is an air-blast device, a spray device, a suction device, a transverse air-blast device, or a blower.

21. The device according to claim 1, further comprising at least one device provided outside the cooling chamber for removing excess coolant from the rolled stock, the at least one device includes a deflector plate that collects the coolant removed by air-blasting or spraying and carries the coolant away from a surface of the strip.

* * * * *